United States Patent [19]

Bingham et al.

[11] Patent Number: 5,029,392

[45] Date of Patent: Jul. 9, 1991

[54] TWO POINT PUNCH

[75] Inventors: John P. Bingham; Edwin R. Burgess, III., both of Naperville, Ill.

[73] Assignee: Ideal Industries, Inc., Sycamore, Ill.

[21] Appl. No.: 564,125

[22] Filed: Aug. 8, 1990

[51] Int. Cl.[5] ..... B26F 1/00

[52] U.S. Cl. ..... 30/360; 30/361; 83/689

[58] Field of Search ..... 30/360, 361; 83/686, 83/688, 689

[56] References Cited

U.S. PATENT DOCUMENTS

| | | | |
|---|---|---|---|
| 267,751 | 11/1882 | Kennedy | 83/689 |
| 1,721,007 | 7/1929 | Doherty et al. . | |
| 1,754,568 | 4/1930 | Nisehan . | |
| 1,817,223 | 8/1931 | Abramson . | |
| 2,214,701 | 9/1940 | Scull | 164/124 |
| 2,221,904 | 11/1940 | Abramson | 164/101 |
| 2,237,069 | 4/1941 | Christenson | 164/101 |
| 3,728,927 | 4/1973 | Pfleiderer | 83/621 |
| 4,543,722 | 10/1985 | Adleman | 30/360 |
| 4,553,164 | 10/1985 | Linquist et al. | 30/360 |
| 4,905,557 | 3/1990 | Adleman | 30/360 |
| 5,269,011 | 8/1966 | Herstrum | 30/360 |

FOREIGN PATENT DOCUMENTS

| | | |
|---|---|---|
| 1415620 | 11/1975 | United Kingdom . |

*Primary Examiner*—Hien H. Phan

*Attorney, Agent, or Firm*—Kinzer, Plyer, Dorn, McEachran & Jambor

[57] ABSTRACT

This is concerned with a punch sometimes referred to as a draw punch which is constructed and arranged for enlarging holes in a large variety of materials, such as sheet metal, for example in junction boxes and the like where large tools cannot be used. More specifically this is concerned with a punch of the above type which is constructed and arranged to cut the metal or slug into two pieces so that may be removed from the die without the assistance of a prying tool.

5 Claims, 1 Drawing Sheet

TWO POINT PUNCH

SUMMARY OF THE INVENTION

This invention is concerned with a punch for removing a slug from relatively thin gauge material which is constructed to cut the slug into at least two pieces.

Another object is a punch of the above type which is inexpensive to manufacture.

Another object is a punch of the above type which is balanced laterally or radially so that shearing of the metal or material will occur approximately simultaneously on opposite sides of the punch.

Another object is a punch that tends to form the material and bend it so that the material deforms more and the slug splits easier.

Another object is a punch of the above type which has an operating face on one end thereof which includes working surfaces defined by four planes.

Other objects will appear from time to time in the ensuing specification and drawings.

DESCRIPTION OF THE INVENTION

Figure 5:
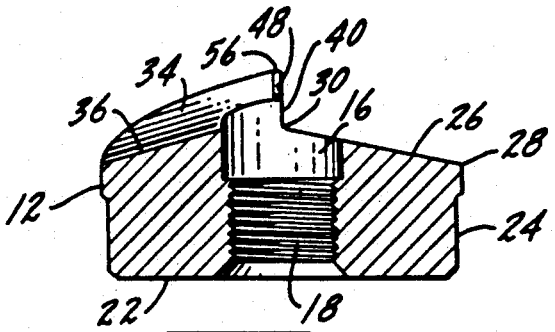
FIG. 5 is a section along 5,5 of FIG. 1.

In FIGS. 1 through 4 the punch body is indicated generally at 10 with a generally cylindrical exterior 12 defined about a generally upright axis 14 with a central opening 16 which may be threaded for at least a portion thereof, as shown at 18 in FIG. 5. For purposes of orientation herein the face 20 of the punch is the working face and will be referred to as the upper or top face while the opposite face 22 may be generally flat and is not a working face and shall be referred to as the bottom face. In use, however, the punch may be oriented with its axis 14 up, down or sideways. So the use of bottom and top are purely for purposes of orientation. Also, the exterior or circumference of the punch may be relieved as at 24 adjacent the bottom face so that when the punch is used the entire length of the punch will not be dragged or forced through the metal being separated.

Figure 3:
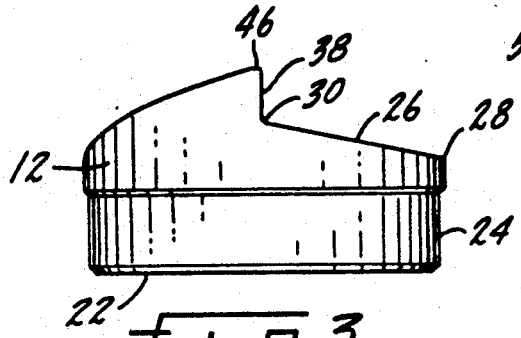
FIG. 3 is an end view of FIG. 1.
Figure 4:
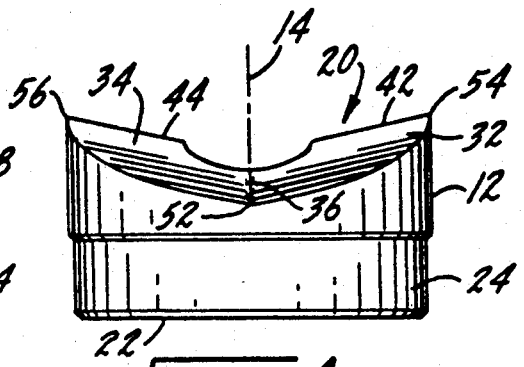
FIG. 4 is a left side view of FIG. 1.

The working face includes a first working area or surface 26 which, as shown, is generally planar and extends around about half of the working face, i.e. about 180°. As shown in FIG. 3, this surface lies on a plane at a certain angle to the axis 14 so that, as viewed in FIG. 3, the surface rises from a low point 28 to a high point 30.

The other side or half of the working face is formed into second and third working surfaces 32 and 34 which are shown as extending circumferentially approximately 90° each with each lying in a plane disposed at an angle to the axis and at oppositely disposed angles so that they intersect each other in what may be considered a trough 36 that is more or less radial. A fourth working surface 38 is separated by the central bore so that it in reality is two surfaces 38 and 40 in FIG. 2 which are defined by a generally vertical plane that coincides with the central axis 14. The line of intersection between the second and third incline surfaces 32 and 34 with the fourth surface 38 and 40, as indicated at 42 and 44, is inclined from the edge or periphery downwardly and inwardly on a diameter which is occasioned by the planes of working faces 32 and 34 being at a greater angle to the axis 14 and the first working surface 26.

Figure 1:
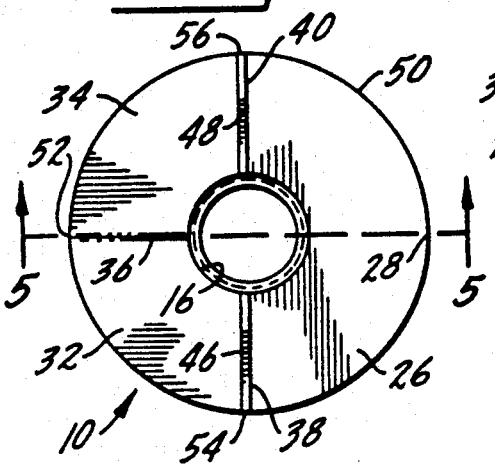
FIG. 1 is a top view of the punch.
Figure 2:
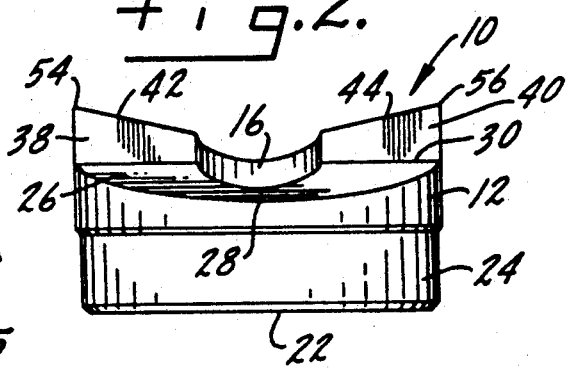
FIG. 2 is a right side view of FIG. 1.

In addition, the lines 42 and 44 are machined off so as to provide radial flats 46 and 48 in FIG. 1.

The result is a peripheral or circular cutting edge 50 which extends around the working face on the exterior of the first, second and third working surfaces as well as the exterior of the radial flats 46 and 48. In addition, it is important that the low point 28 of the first working surface 26 be generally in the same lateral plane as the low point 52 of the trough 36. This is to say that points 28 and 52 would lie generally on the same line or plane that is perpendicular to the axis 14.

The use, operation and function of the invention are as follows.

It is conventional to form a punch of this general character which is drawn into a cooperating cup or die which are brought together by a bolt and nut, such as in U.S. Pat. No. 2,237,069. With the cup, not shown here, placed on one side and the punch depicted here on the other with the bolt passing through a previously existing hole in the material, the working face of the disclosed punch will cut through the material when the bolt and nut draw them together.

The working face of the presently disclosed punch will first penetrate and shear the material on the exterior peripheral high points 54 and 56 of the radial flats 46 and 48. Next, circumferential cutting will take place by the cutting edge of the second and third working surfaces starting at the high points 54 and 56 of the radial flats 46, 48 and moving circumferentially, in FIG. 1 for surface 34 counterclockwise and for surface 32 clockwise. When the point of cutting reaches a plane at right angles to the axis 14 and including line 30 of the first working face 26, the cutting edge of the first working surface 26 will start cutting through the material on opposite sides, clockwise from the top in FIG. 1 and counterclockwise from the bottom. At the same time, cutting will continue by the cutting edges of the second and third working surfaces 32 and 34, counterclockwise for 32 and clockwise for 34 in FIG. 1 but at a slower rate than the rate of cutting of the peripheral edge of the first surface 26. The cutting edge 50 of the first working face 26 will proceed at a more rapid rate than the cutting edge of either working surface 32 or 34 and the cuts on opposite sides of the slug will arrive at the low points 52 and 28 at approximately the same time.

While this is happening, the slug is being split in two by the cutting edges of the flats 46 and 48 so that cuts extend radially inwardly to the center opening. These radial cuts start at the same time that the peripheral cuts start by the cutting edges of the second and third working surfaces 32 and 34 and will be completed before the cutting edge 50 of the first working surface 26 starts to cut.

The result is a fast, efficient, thorough forming of an enlarged hole in the material with the resulting slug being divided into two parts or pieces so that they can be quickly and easily removed without the assistance of a prying tool after disassembly of the cup, the punch, and the nut and bolt.

Whereas the preferred form and several variations of the invention have been shown, described, and suggested, it should be understood that suitable additional modifications, changes, substitutions and alterations may be made without departing from the invention's fundamental theme. It is therefore wished that the invention be unrestricted except as by the appended claims.

The embodiments of the invention in which an exclusive property or privilege is claimed are defined as follows:

1. In a punch for forming holes in various materials such as sheet metal, a generally cylindrical body element with a central opening defined about a generally upright central axis, a working face on one side axially thereof with a peripheral cutting edge bounding the exterior thereof, a diametrically disposed splitting land across the working face divided into two parts by the central opening, each splitting and part sloping upwardly and outwardly from the central opening to the peripheral cutting edge, the working face having two areas divided diametrically by the splitting lands, one area being planar and sloping inwardly and upwardly from the peripheral cutting edge and intersecting the axial plane of the splitting lands below the two parts thereof, the other area of the working face having two generally planar sub areas each of which rises circumferentially and diametrically to join and form one inner diametrical edge of one of the splitting lands and intersecting each other in the opposite peripheral direction in a radial linear junction disposed outwardly and downwardly and extending between the central opening and the peripheral cutting edge.

2. The structure of claim 1 further characterized in that the central opening is threaded.

3. The structure of claim 1 further characterized in that each of the splitting lands has a predetermined generally circumferential distance throughout its radial extent.

4. In a punch for forming holes in various materials, a generally cylindrical body element defined about a generally upright central axis, a working face on one side axially of the body element with a peripheral cutting edge on the exterior thereof, the working face having four planar areas, a first planar area defined by a plane intersecting the central axis at a given angle and providing a planar area of substantial peripheral extent, second and third planar areas defined by planes intersecting the central axis at generally equal angles greater than the given angle and providing planar areas of lesser peripheral extent, the planes of the second and third planar areas being adjacent each other and oppositely inclined so that they intersect in a downwardly and outwardly inclined junction extending to a point on the peripheral cutting edge, and a fourth planar area defined by a vertical plane passing through the central axis and intersecting the second and third planar areas above each of their intersections with the first planar area.

5. The structure of claim 4 further characterized in that the point of the inclined junction on the peripheral cutting edge is generally on a diameter perpendicular to the central axis that intersects the lowest point on the cutting edge of the first planar area.

* * * * *